US006873222B2

(12) United States Patent
Mansour

(10) Patent No.: US 6,873,222 B2
(45) Date of Patent: Mar. 29, 2005

(54) MODIFIED CONDUCTOR LOADED CAVITY RESONATOR WITH IMPROVED SPURIOUS PERFORMANCE

(75) Inventor: Raafat R. Mansour, Waterloo (CA)

(73) Assignee: COM DEV Ltd., Cambridge (CA)

( * ) Notice: Subject to any disclaimer, the term of this patent is extended or adjusted under 35 U.S.C. 154(b) by 41 days.

(21) Appl. No.: 10/006,155

(22) Filed: Dec. 10, 2001

(65) Prior Publication Data

US 2002/0130731 A1 Sep. 19, 2002

Related U.S. Application Data

(60) Provisional application No. 60/254,109, filed on Dec. 11, 2000.

(51) Int. Cl.[7] ..... H01P 1/20; H01P 7/06

(52) U.S. Cl. ..... 333/99 S; 333/202; 333/219.1; 333/227

(58) Field of Search ..... 333/99 S, 202, 333/219.1, 227; 505/210; 331/96, 107 DP

(56) References Cited

U.S. PATENT DOCUMENTS 4,423,397 A * 12/1983 Nishikawa et al. ..... 333/219.1
4,871,986 A * 10/1989 Ballato ..... 331/158
5,179,074 A * 1/1993 Fiedziuszko et al. ..... 505/210
5,804,534 A * 9/1998 Zaki ..... 505/210
6,081,175 A * 6/2000 Duong et al. ..... 333/212
6,314,309 B1 * 11/2001 Abdelmonem ..... 505/210
2003/0025569 A1 * 2/2003 Tiihonen ..... 333/17.1

FOREIGN PATENT DOCUMENTS

EP 1215747 A1 * 6/2002 ..... H01P/1/208

OTHER PUBLICATIONS

Salehi et al 'Modified conductor loaded resonator with improved spurious performance', Microwave Symposium Digest, 2001 IEE E MTT–S International, May 2001 pp. 1779–1782.*

Wang et al 'Conductor loaded resonator filters with wide spurious free stop band' Microwave Symposium Digest., 2000 2000 IEEE MTT–S International, vol. 2, Jun. 1997 pp. 1079–1082.*

Mansour et al 'Quasi Dual Mode Resonators ', Microwave Symposium Digest., 2000 IEE E MTT–S International, vol. 1, Jun. 2000, pp. 183–186.*

* cited by examiner

*Primary Examiner*—Robert Pascal
*Assistant Examiner*—Kimberly Glenn
(74) *Attorney, Agent, or Firm*—Daryl W. Schnurr

(57) ABSTRACT

A microwave cavity has a cut resonator therein that is conductor-loaded. Filters made from one or more cavities having cut resonators therein have improved spurious performance over previous filters. A filter can have two conductor loaded resonators in one cavity or a combination of conductor loaded resonators and dielectric resonators in different cavities.

36 Claims, 9 Drawing Sheets

MODIFIED CONDUCTOR LOADED CAVITY RESONATOR WITH IMPROVED SPURIOUS PERFORMANCE

This application claims benefit to U.S. Provisional Application 60/254,109 filed on Dec. 11, 2000.

BACKGROUND OF THE INVENTION

1. Field of Invention

The present invention is related to microwave bandpass filters and more particularly to the realization of compact size conductor-loaded cavity filters for use in space, wireless applications and other applications where size and spurious performance of the bandpass filters are critical.

2. Description of the Prior Art

Microwave filters are key components of any communication systems. Such a system, be it wireless or satellite, requires filters to separate the signals received into channels for amplification and processing. The phenomenal growth in telecommunication industry in recent years has brought significant advances in filter technology as new communication systems emerged demanding equipment miniaturization while requiring more stringent filter characteristics. Over the past decade, the dielectric resonator technology has been the technology of choice for passive microwave filters for wireless and satellite applications.

FIG. 1 illustrates the traditional dual-mode conductor-loaded cavity resonator. The resonator 1 is mounted in a planar configuration inside a rectangular cavity 2. Table 1 provides the resonant frequency of the first three resonant modes.

TABLE 1

Resonant frequency of prior art dual-mode conductor loaded cavity resonators Metal puck: (0.222" × 2.4" dia), Rectangular cavity: (1.9" × 3.2" × 3.2") Cylindrical cavity: 1.9" × 3.2" dia.

| Mode | Resonant Frequency Rectangular Cavity | Resonant Frequency Cylindrical Cavity |
|---|---|---|
| Mode 1 | 1.889 GHz | 1.940 GHz |
| Mode 2 | 2.506 GHz | 2.733 GHz |
| Mode 3 | 3.434 GHz | 3.322 GHz |

SUMMARY OF THE INVENTION

It is an object of the present invention to provide a novel configuration etc. both single mode and dual mode dielectric resonator filters have been employed for such applications. It is a further object of the present invention to provide a conductor-loaded cavity resonator filter that can be used in conventional and cryogenic applications. It is still another object of the present invention to provide a filter that is compact in size with a remarkable loss spurious performance compared to previous filters.

A microwave cavity has at least one wall. The cavity has a cut resonator located therein, the resonator being out of contact with the at least one wall.

A bandpass filter has at least one cavity. The at least one cavity has a cut resonator therein. The cavity has at least one wall and the resonator is out of contact with the at least one wall.

A method of improving the spurious performance of a bandpass filter, the method comprising a cut resonator in at least one cavity of the filter, the cavity having at least one wall and the resonator being located out of contact with the at least one wall.

DESCRIPTION OF A PREFERRED EMBODIMENT

Figure 1:
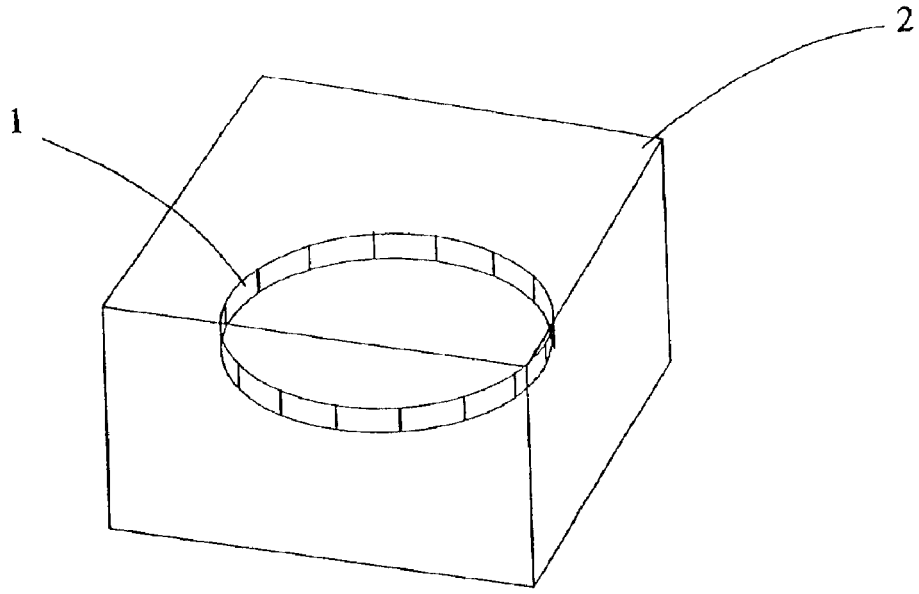
Figure 1. Prior Art
FIG. 1 is a perspective view of a prior art dual mode conductor-loaded cavity resonator where the resonator is mounted inside a metallic enclosure.

The resonator of FIG. 1 is a metallic resonator and the cavity 2 is a metallic enclosure. The electric field of the first mode resembles the $TE_{11}$ in cylindrical cavities. Thus, the use of a magnetic wall symmetry will not change the field distribution and consequently the resonant frequency.

Figure 2:
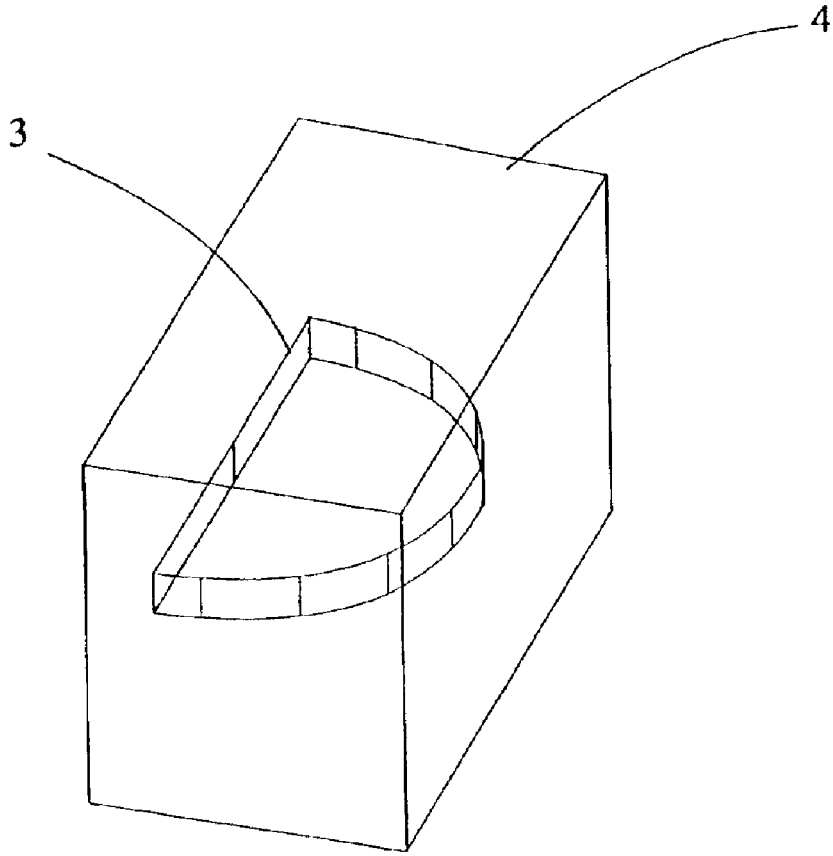
FIG. 2 is a perspective view of a half cut resonator contained within a cavity.

In FIG. 2, there is shown a half cut resonator 3 mounted in a cavity 4. It can be seen that the resonator 3 has a semicircular shape. The resonator 3 is mounted on a support (not shown) and is out of contact with walls of the cavity 4. The resonator 3 does not touch the walls of the cavity 4. The cavity 4 has almost half the volume of the cavity 2 shown in FIG. 1. A dielectric support structure (not shown) is used in both FIGS. 1 and 2 to support the resonator.

Figure 3:
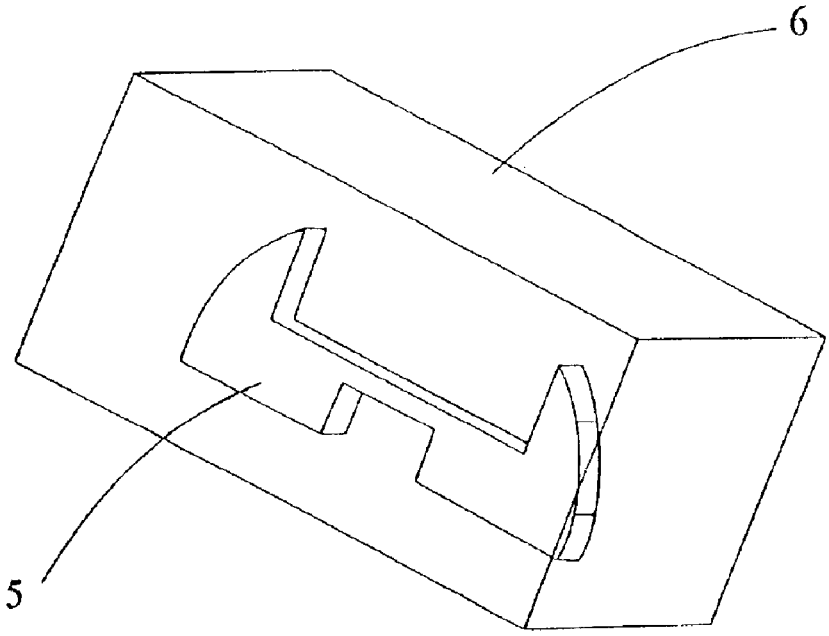
FIG. 3 is a perspective view of a modified half cut resonator contained within a cavity.
Figure 4:
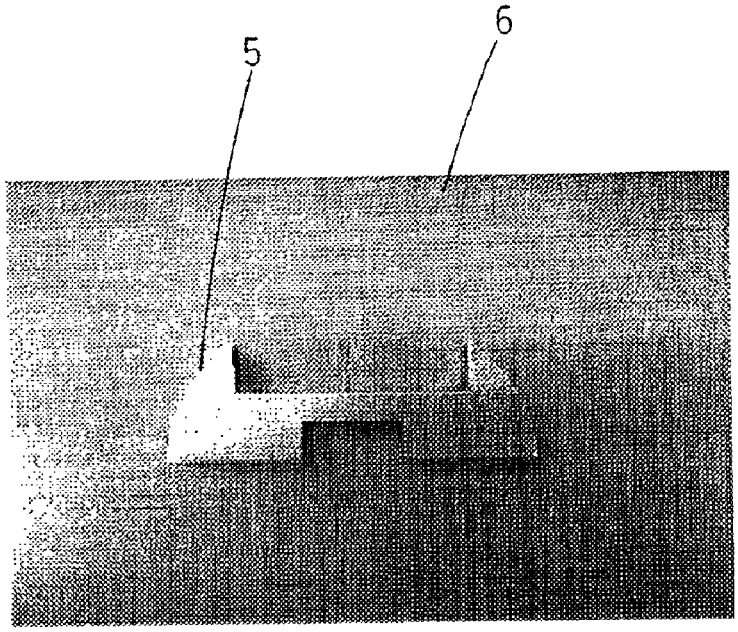
FIG. 4 is a top view of a shaped resonator.

With the use of the magnetic wall symmetry concept, a half-cut version of the conductor-loaded resonator with a modified shape can be realized as shown in FIG. 3. The half-cut resonator would have a slightly higher resonant frequency with a size that is 50% of the original dual-mode cavity. The technique proposed in Wang et al "Dual mode conductor-loaded cavity filters" I. EEE Transactions on Microwave Theory and Techniques, V45, N. 8, 1997 can be applied for shaping dielectric resonators to conductor-loaded cavity resonators. In FIG. 4, there is shown a top view of the modified half-cut resonator of FIG. 3. The original half-cut resonator described in FIG. 2 is selectively machined to enhance the separation between the resonant frequencies of the dominant and the first higher-order mode. It can be seen that a substantially rectangular cutaway portion exists in a straight edge of the resonator 5 and a larger rectangular shaped cut away portion is located in the arcuate edge of the resonator 5. Both of the cut away portions are substantially centrally located.

Table 2 provides the resonant frequencies of the first three modes of the half-cut conductor-loaded resonator. Even though the TM mode has been shifted away, the spurious performance of the resonator has degraded.

TABLE 2

| The resonant frequencies of the first three modes of the half-cut conductor-loaded resonator | |
|---|---|
| Mode | Resonant Frequency |
| Mode 1 | 2.119 GHz |
| Mode 2 | 2.234 GHz |
| Mode 3 | 3.824 GHz |

Table 3 gives the resonant frequencies of the first three modes of the modified half-cut resonator. A comparison between Tables 2 and 3 illustrates that the spurious performance of the modified half-cut resonator is superior to that of dual-mode resonators. It is interesting to note that shaping the resonator as shown in FIG. 3 has shifted Mode 1 down in frequency while shifting Mode 2 up in frequency. This translates to a size reduction and a significant improvement in spurious performance.

TABLE 3

| The resonant frequencies of the first three modes of the modified half-cut conductor-loaded resonator | |
|---|---|
| Mode | Resonate Frequency |
| Mode 1 | 1.559 GHz |
| Mode 2 | 2.980 GHz |
| Mode 3 | 3.535 GHz |

It is well known that dielectric resonators filters suffer from limitations in spurious performance and power handling capability. By combining the dielectric resonators with the resonator disclosed in this invention both the spurious performance and power handling capability of dielectric resonator filters can be considerably improved.

FIG. 4 shows a resonator 5 mounted inside an enclosure 6. The resonator 5 is a modified version of the resonator 3 shown in FIG. 2 where a metal is machined out in specific areas to improve the spurious performance of the resonator. FIG. 4 is an actual picture of the resonator 5 in the open cavity 6.

Figure 5:
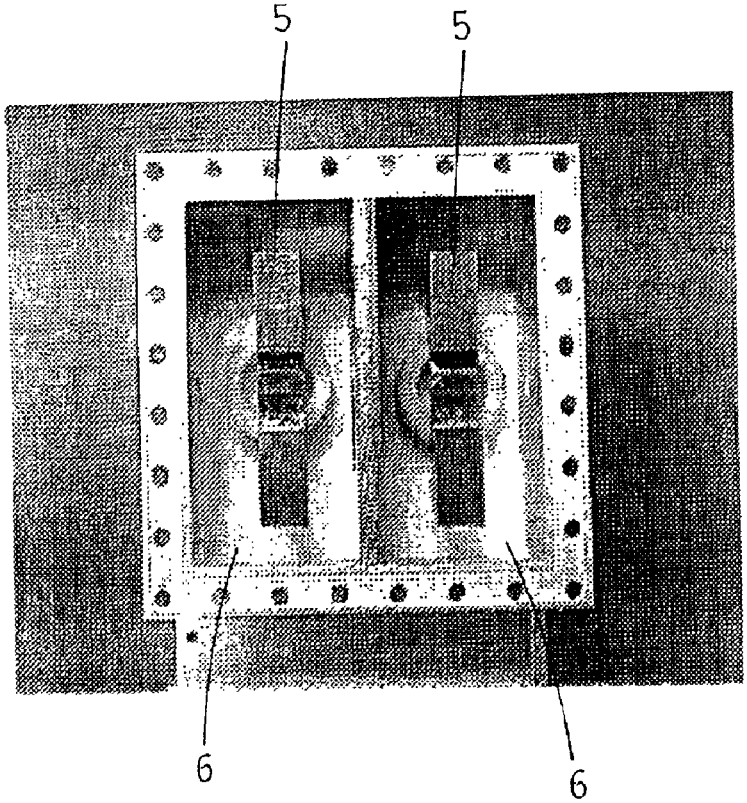
FIG. 5 is a top view of a two pole filter containing shaped resonators.
Figure 6:
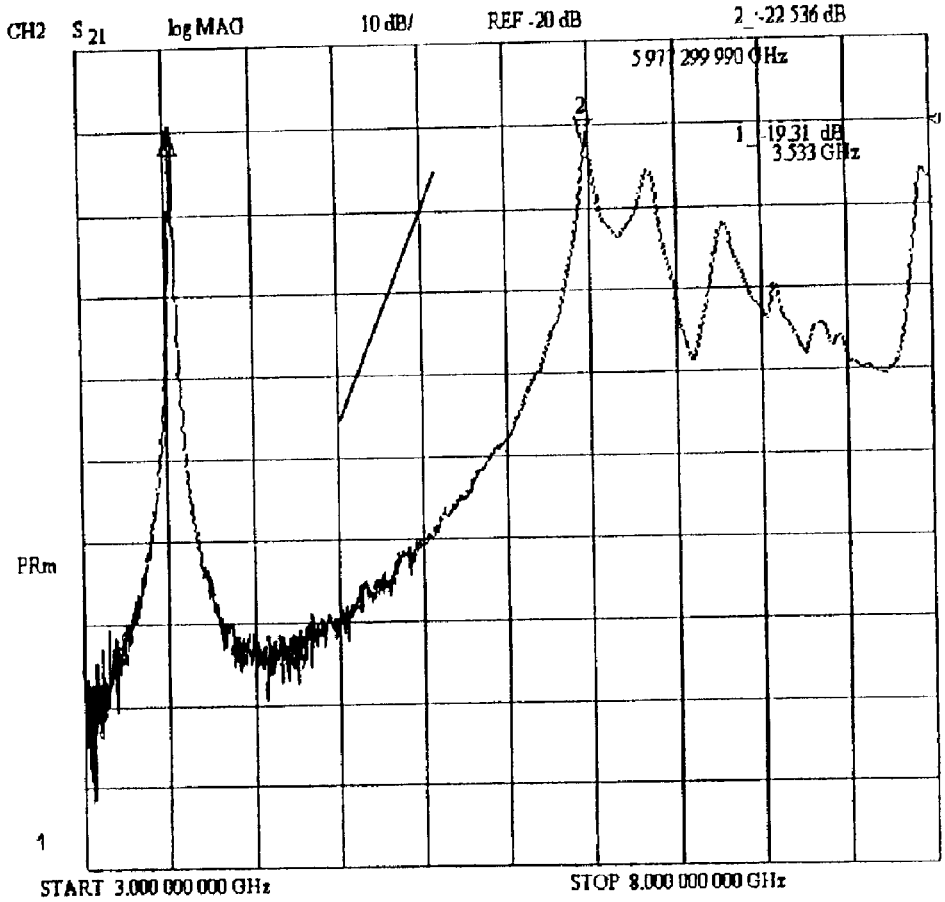
FIG. 6 is a graph showing the measured isolation results of the filter described in FIG. 5.

FIG. 5 shows a picture of a two pole filter built using the resonator 5. The filter consists of two resonators coupled by an iris (not shown). FIG. 6 shows the experimental isolation results of the filter shown in FIG. 5. The results demonstrate the improvement in spurious performance. The spurious area is located at approximately twice the filter centre frequency.

Figure 7:
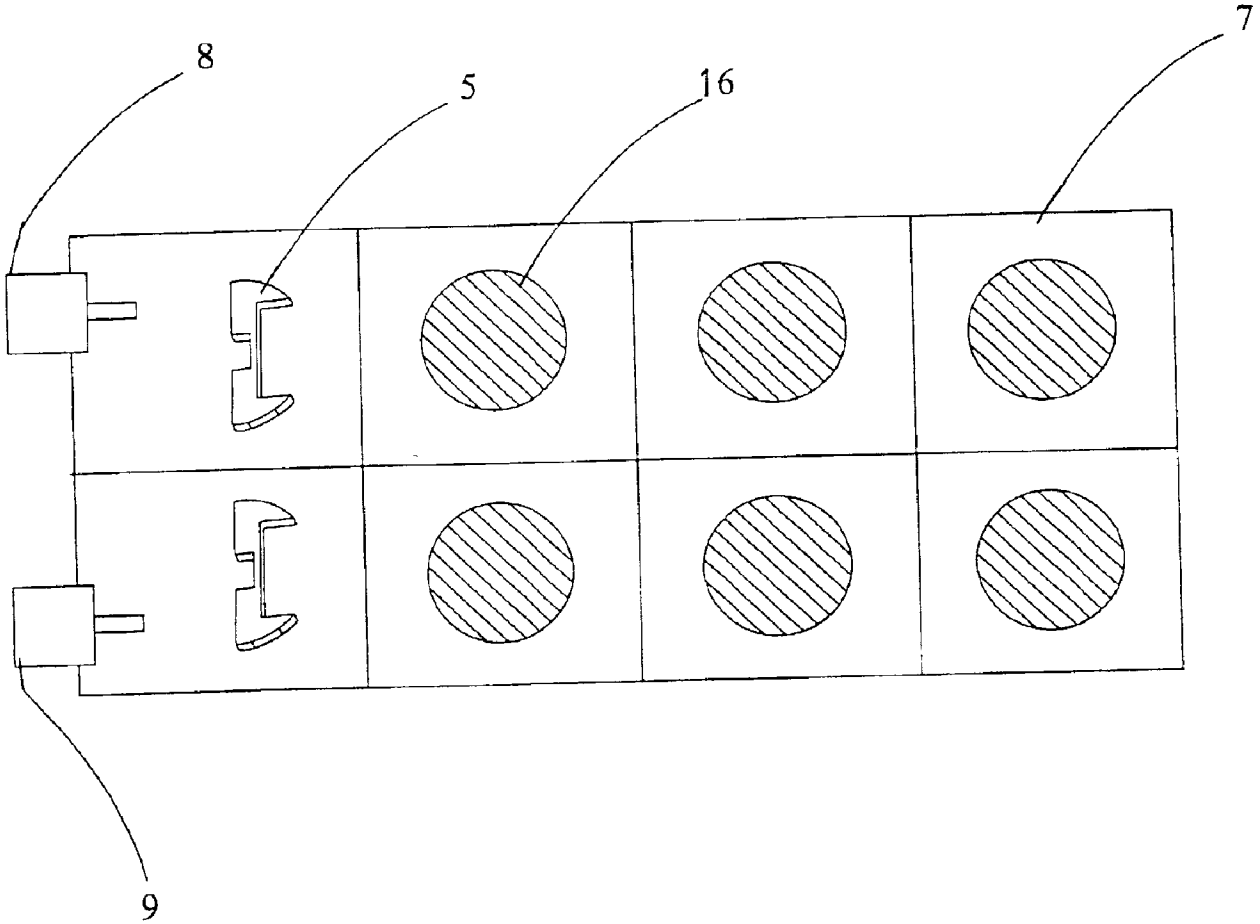
FIG. 7 is a schematic top view of an 8-pole filter having conductor-loaded resonators in two cavities and dielectric resonators in the remaining cavity.

FIG. 7 shows an eight-pole filter where six dielectric resonators 6 are used in six cavities 7 in combination with two half-cut metallic resonators 5 in two cavities 7. The RF energy is coupled to the filter through input/output probes 8, 9 respectively. The metallic resonators could be placed horizontally as shown in FIG. 7 or vertically. Even though the dielectric resonator filters have a limited spurious performance, the addition of the two metallic resonators considerably improves the overall spurious performance of the filter. In FIG. 7, the metallic resonators are placed in the first and last cavities. However, metallic resonators can be placed in any of the cavities.

Figure 8:
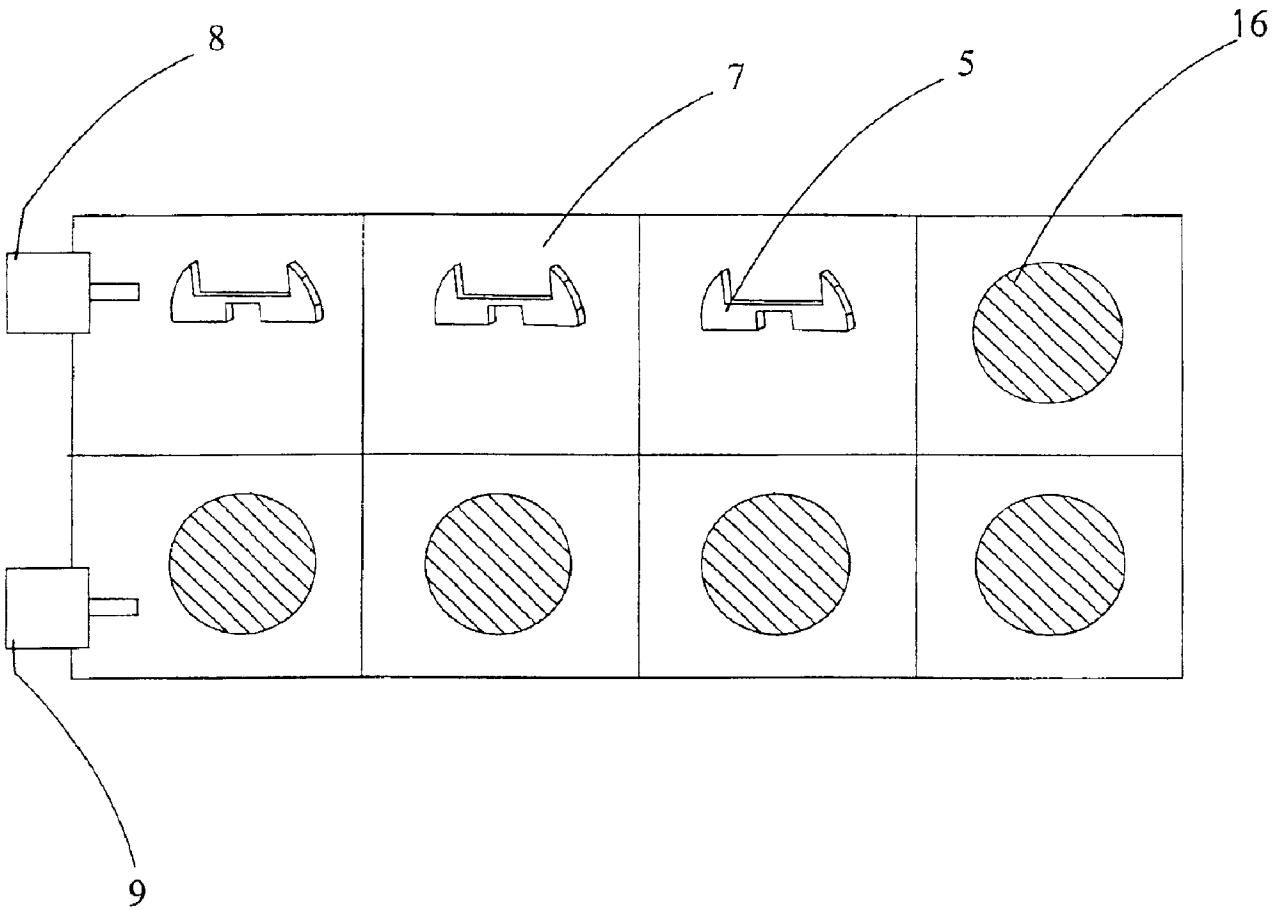
FIG. 8 is a schematic top view of an 8-pole filter having conductor-loaded resonators in three cavities and dielectric resonators in the remaining cavities.

FIG. 8 shows an eight-pole filter where five dielectric resonators 6 are located in five cavities 7 in combination with three half-cut metallic resonators 5 located in three cavities 7. The RF energy is coupled to the filter through input/output probes 8, 9 respectively. The metallic resonators are placed in the first three cavities to improve the power handling capability of the dielectric resonator filter. It well known that, in high power applications, high electric field will build up in the first three cavities. Such high field translates into heat, which in turn degrades the Q of the resonator, and affects the integrity of the support structure. The problem can be circumvented by replacing the dielectric resonators in these cavities with metallic resonators disclosed in this invention. In both FIG. 7 and FIG. 8, there is one resonator in each cavity.

Figure 9:
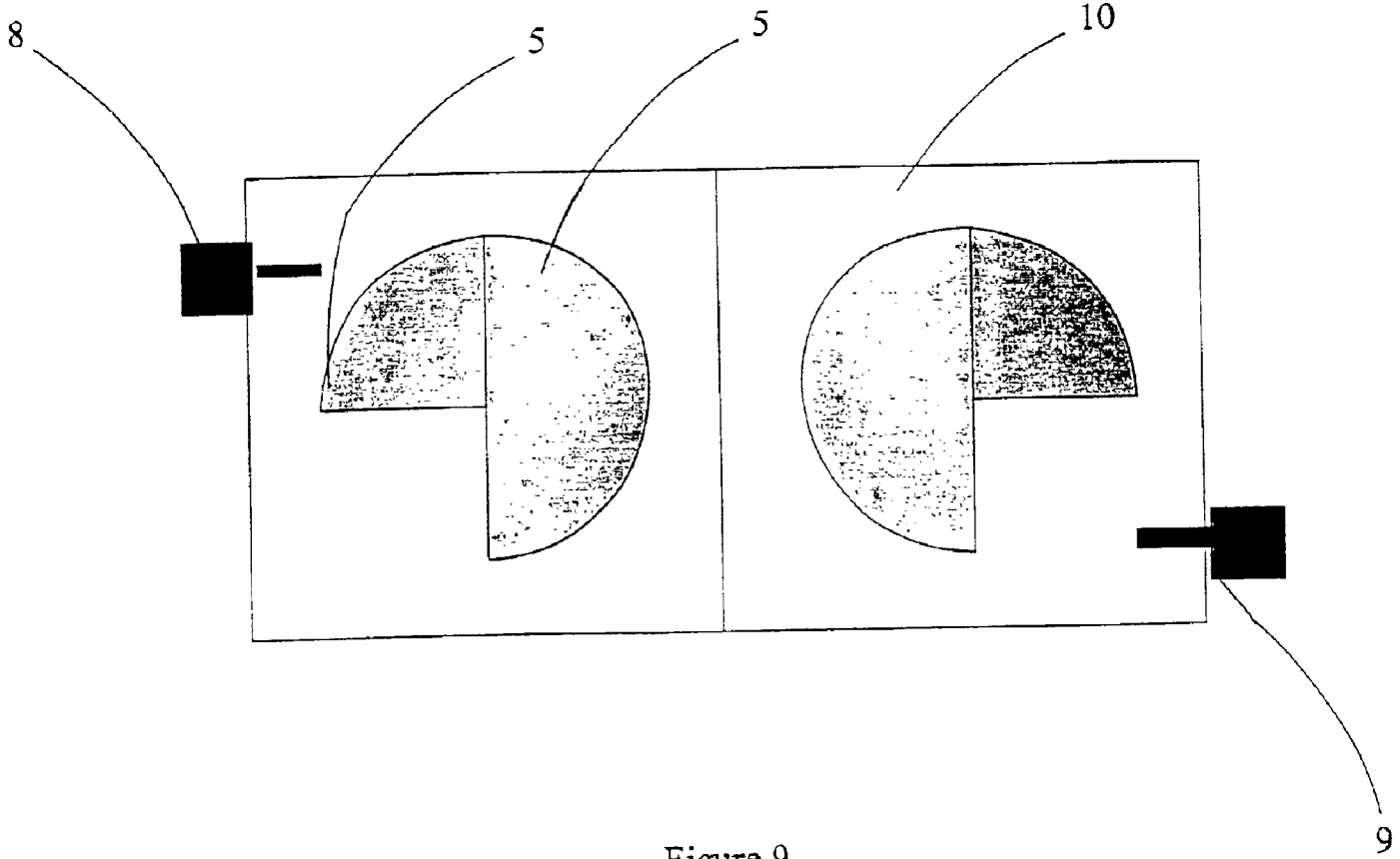
FIG. 9 is a schematic top view of a dual-mode filter having two conductor loaded resonators in each cavity.

FIG. 9 shows a four pole dual-mode filter consisting of two dual-mode resonators 10 in each cavity 7. Each dual-mode resonator is formed by combining two single-mode resonators 5. The end result is a compact dual-mode resonator with an improved spurious performance.

A combination of dielectric resonators and conductor-loaded cavity resonators in the same filter improves the spurious performance of dielectric resonator filters over dielectric resonator filters that do not have any conductor-loaded cavity resonators. The use of conductor-loaded cavity resonators in the same filter in combination with dielectric resonators extend the power handling capability of dielectric resonator filters.

Various materials are suitable for the resonators. For example, the resonator can be made of any metal or it can be made of superconductive material either by a thick film coating or bulk superconductor materials or single crystal or by other means. Copper is an example of a suitable metal.

I claim:

1. A bandpass filter comprising at least one cavity with said at least one cavity having a cut resonator therein, said cavity having at least one wall and said resonator being out of contact with said at least one wall, said resonator being a conductor-loaded resonator and being non-cylindrical, said resonator being mounted on a dielectric support.

2. A filter as claimed in claim 1 wherein said resonator is selected from the group of a half cut resonator and a quarter cut resonator.

3. A filter as claimed in claim 2 wherein the cavity has a rectangular shape and said resonator is planar mounted.

4. A filter as claimed in claim 3 wherein said resonator has a modified shape.

5. A filter as claimed in claim 4 wherein said modified shape has at least one cut away portion.

6. A filter as claimed in claim 4 where said modified shape has at least a first cut away portion and a second cut away portion.

7. A filter as claimed in claim 4 wherein said resonator has a semicircular shape with one straight edge and a first cut away portion having a rectangular shape and being substantially centrally located in said straight edge.

8. A filter as claimed in claim 7 wherein said resonator has a substantially arcuate edge and second cut away portion having a rectangular shape that is substantially centrally located in said arcuate edge.

9. A filter as claimed in claim 8 wherein said resonator wherein said second cut away portion is larger than said first cut away portion.

10. A filter as claimed in claim 4 wherein the modified shape of said resonator is cut away portions in specific areas to improve spurious performance.

11. A filter as claimed in claim 4 wherein there are at least two conductor-loaded resonators located in said at least one cavity to create a dual mode conductor-loaded cavity resonator with improved spurious performance.

12. A filter as claimed in claim 2 wherein said resonator is made from superconductive material.

13. A filter as claimed in claim 2 wherein said conductor-loaded resonator is used in combination with at least one dielectric resonator.

14. A filter as claimed in claim 13 wherein said filter has eight cavities, a first cavity and a last cavity containing conductor loaded resonators and the remaining cavities containing dielectric resonators.

15. A filter as claimed in claim 13 wherein said filter has eight cavities, a first, second and third cavity each containing a conductor-loaded resonator and the remaining cavities containing dielectric resonators.

16. A filter as claimed in claim 2 wherein said filter has at least two cavities, there being a conductor-loaded resonator in one of said at least two cavities and a dielectric resonator in the other of said at least two cavities.

17. A filter as claimed in claim 2 wherein said at resonator has a mode selected from the group of a single mode and a dual mode.

18. A filter as claimed in claim 2 wherein said conductor-loaded resonator is made from a material selected from the group of metallic, superconductive, thick film superconductive and single crystal.

19. A filter as claimed in claim 2 wherein said resonator is made from copper.

20. A microwave cavity having at least one wall, said cavity comprising a cut resonator located therein, said resonator being out of contact with said at least one wall, said resonator being a conductor-loaded resonator and being non-cylindrical, said resonator being mounted on a dielectric support.

21. A cavity as claimed in claim 20 wherein said resonator is selected from the group of a half cut resonator and a quarter cut resonator.

22. A cavity as claimed in claim 21 wherein said cavity has a rectangular shape and said resonator is planar or mounted.

23. A cavity as claimed in claim 22 wherein said resonator has a modified shape.

24. A cavity as claimed in claim 23 wherein said modified shape has at least one cut away portion.

25. A cavity as claimed in claim 23 wherein said modified shape has at least a first cut away portion and a second cut away portion.

26. A cavity as claimed in claim 23 wherein said resonator has a semicircular shape with one straight edge and a first cutaway portion having a rectangular shape and being substantially centrally located in said straight edge.

27. A cavity as claimed in claim 26 wherein said resonator has an arcuate edge and a second cut away portion having a rectangular shape that is substantially centrally located in said arcuate edge.

28. A cavity as claimed in claim 23 wherein said resonator has a substantially arcuate edge and a second cut away portion having a rectangular shape that is substantially centrally located in said arcuate edge.

29. A cavity as claimed in claim 23 wherein the modified shape of said resonator are cut away portions in specific areas to improve spurious performance.

30. A cavity as claimed in claim 23 wherein there are at least two conductor loaded resonators located in said cavity to create a dual mode conductor-loaded cavity resonator with improved spurious performance.

31. A cavity as claimed in claim 22 wherein said resonator is made from metal.

32. A filter as claimed in claim 21 wherein said resonator is made from superconductive material.

33. A cavity as claimed in claim 21 wherein said conductor loaded resonator is used in combination with at least one dielectric resonator.

34. A cavity as claimed in claim 21 wherein said conductor loaded resonator is made from a material selected from the group of metallic, superconductive, thick film superconductive and single crystal.

35. A cavity as claimed in claim 21 wherein said resonator is made from copper.

36. A method of improving the spurious performance of a bandpass filter said method comprising locating a conductor-loaded cut resonator in at least one cavity of said filter, said cavity having at least one wall and said resonator being located out of contact with said at least one wall.

* * * * *